US005595096A

United States Patent [19]

Coffman

[11] Patent Number: 5,595,096

[45] Date of Patent: Jan. 21, 1997

[54] ENGLISH-METRIC WRENCH SOCKET OR DRIVE

[76] Inventor: George L. Coffman, 563 S. Burgess Ave., Columbus, Ohio 43204

[21] Appl. No.: 582,953

[22] Filed: Jan. 4, 1996

[51] Int. Cl.[6] ..... B25B 13/06

[52] U.S. Cl. ..... 81/121.1; 81/186

[58] Field of Search ..... 81/121.1, 119, 81/DIG. 5, 186, 125.1

[56] References Cited

U.S. PATENT DOCUMENTS

| | | | |
|---|---|---|---|
| 3,916,736 | 11/1975 | Clemens | 81/DIG. 5 X |
| 4,646,594 | 3/1987 | Tien | 81/121.1 |
| 5,388,486 | 2/1995 | Ruzicka et al. | 81/121.1 X |

FOREIGN PATENT DOCUMENTS

| | | | |
|---|---|---|---|
| 2092042 | 8/1982 | United Kingdom | 81/119 |

*Primary Examiner*—D. S. Meislin

[57] ABSTRACT

An English-Metric drive including a generally cylindrical rigid body having a polygonal shaped bore extended axially therethrough and with the polygonal shaped bore bounded by a first hexagonal arrangement of twelve planar primary facets axially aligned with and offset from a second hexagonal arrangement of twelve planar secondary facets to thereby create a set of six primary points and a set of six secondary points with each primary point formed of a pair of primary facets joined at an apex and with each secondary point formed of a pair of secondary facets joined at an apex and wherein a first distance as measured between one of the primary facets of one of the primary points of the first arrangement and the parallel primary facet positioned directly opposite thereto is between about ½ to 3½% different than a second distance as measured between one of the secondary facets of one of the secondary points of the second arrangement and the parallel secondary facet positioned directly opposite thereto.

10 Claims, 4 Drawing Sheets

ENGLISH-METRIC WRENCH SOCKET OR DRIVE

BACKGROUND OF THE INVENTION

1. Field of the Invention

The present invention relates to an English-Metric wrench socket or drive and more particularly pertains to accommodating similarly sized English and Metric nut-type fasteners for effecting sustained nut-turning loads of such fasteners without slippage with an English-Metric wrench socket or drive.

2. Description of the Prior Art

The use of wrenches is known in the prior art. More specifically, wrenches heretofore devised and utilized for the purpose of accommodating nut-type fasteners for tightening are known to consist basically of familiar, expected and obvious structural configurations, notwithstanding the myriad of designs encompassed by the crowded prior art which have been developed for the fulfillment of countless objectives and requirements.

By way of example, U.S. Pat. No. Design 246,415 to Critcher discloses a wrench socket. U.S. Pat. No. Design 250,167 to D'Oporto discloses a wrench socket. U.S. Pat. No. Design 262,432 to Levy discloses a wrench socket. U.S. Pat. No. Design 3,972,253 to Rockwell et al. discloses a multi-sized socket wrench. U.S. Pat. No 4,126,063 to Palmer discloses wrench sockets. U.S. Pat. No 4,436,004 to Chang discloses a universal multi-socket ratchet wrench.

While these devices fulfill their respective, particular objective and requirements, the aforementioned patents do not describe an English-Metric wrench socket or drive that allows a single drive or socket to be used to accommodate tightening and loosening comparably sized English or Metric fasteners.

In this respect, the English-Metric wrench socket or drive according to the present invention substantially departs from the conventional concepts and designs of the prior art, and in doing so provides an apparatus primarily developed for the purpose of accommodating similarly sized English and Metric nut-type fasteners that are complements thereof for effecting sustained nut-turning loads without slippage.

Therefore, it can be appreciated that there exists a continuing need for new and improved English-Metric wrench socket or drive which can be used for accommodating similarly sized English and Metric nut-type fasteners that are complements thereof for effecting sustained nut-turning loads without slippage. In this regard, the present invention substantially fulfills this need.

SUMMARY OF THE INVENTION

In the view of the foregoing disadvantages inherent in the known types of wrenches now present in the prior art, the present invention provides an improved English-Metric wrench socket or drive. As such, the general purpose of the present invention, which will be described subsequently in greater detail, is to provide a new and improved English-Metric wrench socket or drive and method which has all the advantages of the prior art and none of the disadvantages.

To attain this, the present invention essentially comprises a generally cylindrical rigid body including a first free end having a bore with a square cross section extended axially therethrough, a second free end with a polygonal shaped bore extended axially therethrough and with the polygonal shaped bore bounded by a first hexagonal arrangement of twelve planar primary facets axially aligned with and offset by about thirty degrees from a second hexagonal arrangement of twelve planar secondary facets to thereby create a set of six primary points and a set of six secondary points with each primary point formed of a pair of primary facets joined at an apex to create an angle of about sixty degrees therebetween and with each secondary point formed of a pair of secondary facets joined at an apex to create an angle of about sixty degrees therebetween and wherein a first distance as measured between one of the primary facets of one of the primary points of the first arrangement and the parallel primary facet positioned directly opposite thereto is between about ½ to 3½% different than a second distance as measured between one of the secondary facets of one of the secondary points of the second arrangement and the parallel secondary facet positioned directly opposite thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved English-Metric wrench socket or drive which has all the advantages of the prior art wrenches and none of the disadvantages.

It is another object of the present invention to provide a new and improved English-Metric wrench socket or drive which may be easily and efficiently manufactured and marketed.

It is a further object of the present invention to provide a new and improved English-Metric wrench socket or drive which is of durable and reliable construction.

An even further object of the present invention is to provide a new and improved English-Metric wrench socket or drive which is susceptible of a low cost of manufacture with regard to both materials and labor, and which accordingly is then susceptible of low prices of sale to the consuming public, thereby making such an English-Metric wrench socket or drive economically available to the buying public.

Still yet another object of the present invention is to provide a new and improved English-Metric wrench socket or drive which provides in the apparatuses and methods of the prior art some of the advantages thereof, while simultaneously overcoming some of the disadvantages normally associated therewith.

Even still another object of the present invention is to provide a new and improved English-Metric wrench socket or drive for accommodating similarly sized English and Metric nut-type fasteners that are complements thereof for effecting sustained nut-turning loads without slippage.

Lastly, it is an object of the present invention to provide a new and improved English-Metric wrench socket or drive for accommodating similarly sized English and Metric nut-type fasteners that are complements thereof for effecting sustained nut-turning loads without slippage comprising a generally cylindrical rigid body including a polygonal shaped bore extended axially therethrough and with the polygonal shaped bore bounded by a first hexagonal arrangement of twelve planar primary facets axially aligned with and offset from a second hexagonal arrangement of twelve planar secondary facets to thereby create a set of six primary points and a set of six secondary points with each primary point formed of a pair of primary facets joined at an apex and with each secondary point formed of a pair of secondary facets joined at an apex and wherein a first distance as measured between one of the primary facets of one of the primary points of the first arrangement and the parallel primary facet positioned directly opposite thereto is between about ½ to 3½% different than a second distance as measured between one of the secondary facets of one of the secondary points of the second arrangement and the parallel secondary facet positioned directly opposite thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
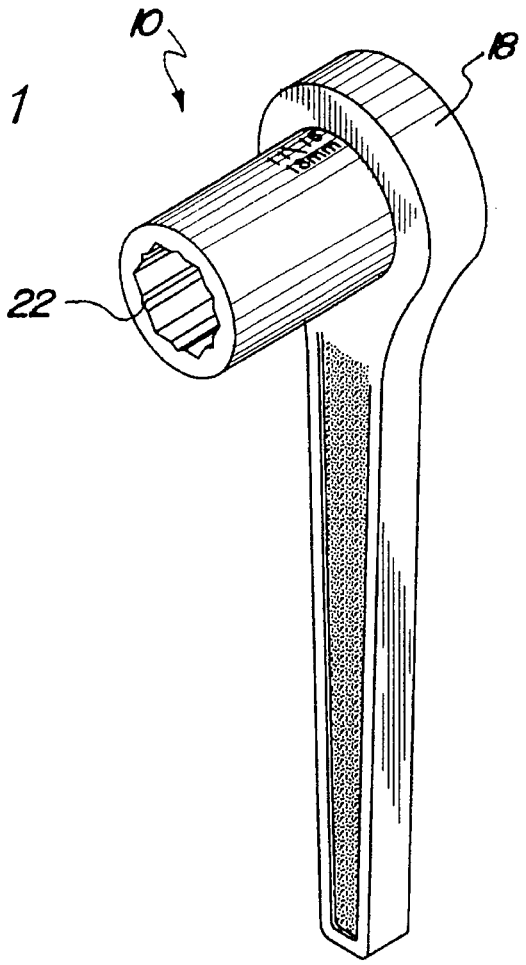
FIG. 1 is a perspective view of the preferred embodiment constructed in accordance with the principles of the present invention removably secured to a ratchet wrench.
Figure 2:
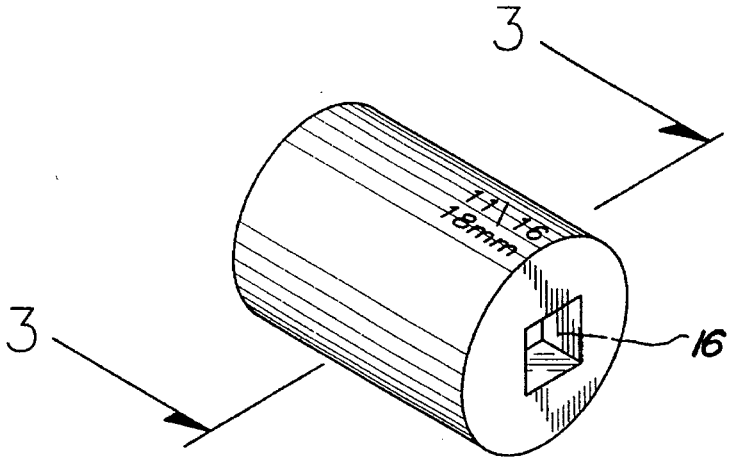
FIG. 2 is another perspective view of the preferred embodiment of the present invention.
Figure 3:
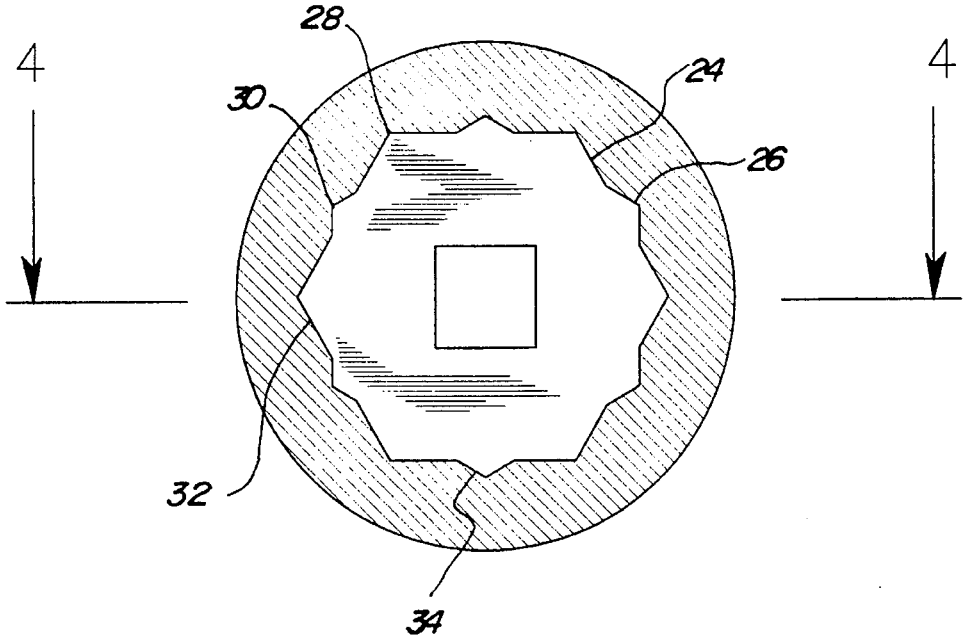
FIG. 3 is a cross-sectional view of the present invention taken along the line 3—3 of FIG. 2.
Figure 4:
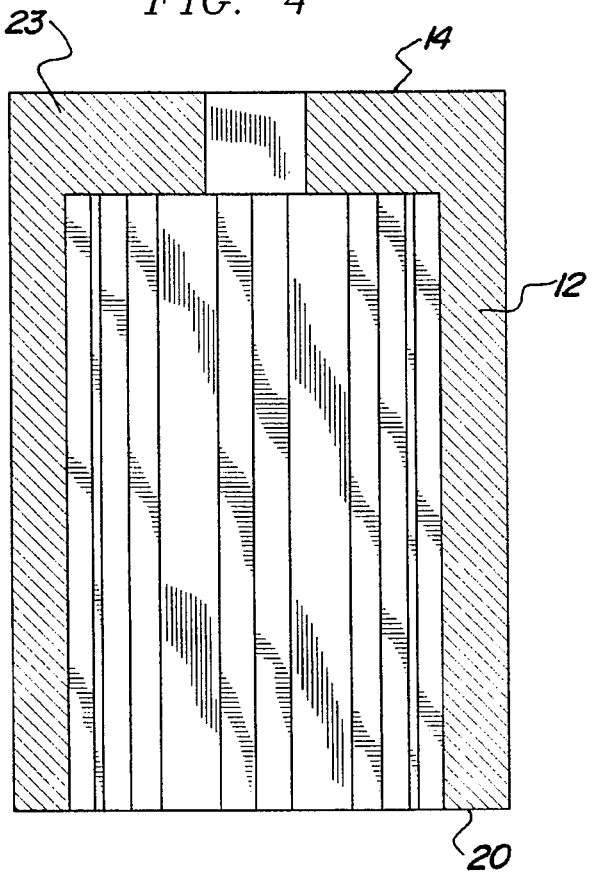
FIG. 4 is yet another cross-sectional view of the present invention taken along the line 4—4 of FIG. 3.

With reference now to the drawings, and in particular, to FIG. 1 thereof, the preferred embodiment of the new and improved English-Metric wrench socket or drive embodying the principles and concepts of the present invention and generally designated by the reference number 10 will be described.

The preferred embodiment of the present invention is designed to accommodate similarly sized English and Metric nut-type fasteners. The present invention effects is used to sustain nut-turning loads on such fasteners without slippage. The present invention can be utilized in a stand-alone type fashion or used as part of another tool.

Specifically, the preferred embodiment of the present invention in a socket-type configuration as shown in FIGS. 1 through 4. This configuration consists of a body 12. The body is generally cylindrical in shape. It is formed of a rigid hardened metal material of sufficient resilience to sustain nut-turning loads. The body has a first free end 14 with a bore 16 extended axially therethrough. Bore 16 has a square cross-section and is sized to accommodate an end of a ratchet wrench 18. The body also has a second free end 20 with a polygonal shaped bore 22 extended axially therethrough. Bore 22 is placed in communication with the bore 16. Since bore 22 is of a larger extent than bore 16, a flange 23 is created therebetween and located near the first free end 14. The polygonal shaped bore 22 is bounded by a first hexagonal arrangement of 12 planar primary facets 24 that are axially aligned and offset by about 30 degrees from a second arrangement of 12 planar secondary facets 26. The combination of the first and second hexagonal arrangements thereby create a set of six primary points 28 and a set of six secondary points 30. Each primary point is formed of a pair of long primary facets 24 joined at an apex and with the pair creating an angle of about 60-degrees therebetween. Similarly, each secondary point is formed of a pair of short secondary facets 26 joined at an apex and with the pair creating an angle of about 60 degrees therebetween. A first distance as measured between one of the primary facets 24 of one of the primary points of the first arrangement and the parallel primary facet 32 positioned directly opposite thereto is between about ½ to 3½% different than a second distance as measured between one of the secondary facets 26 of one of the secondary primary points of the second arrangement and the parallel secondary facet 34 positioned directly opposite thereto. The differences in distances allow comparably sized English and Metric nuts and fasteners to be accommodated within the same body 12.

Figure 5:
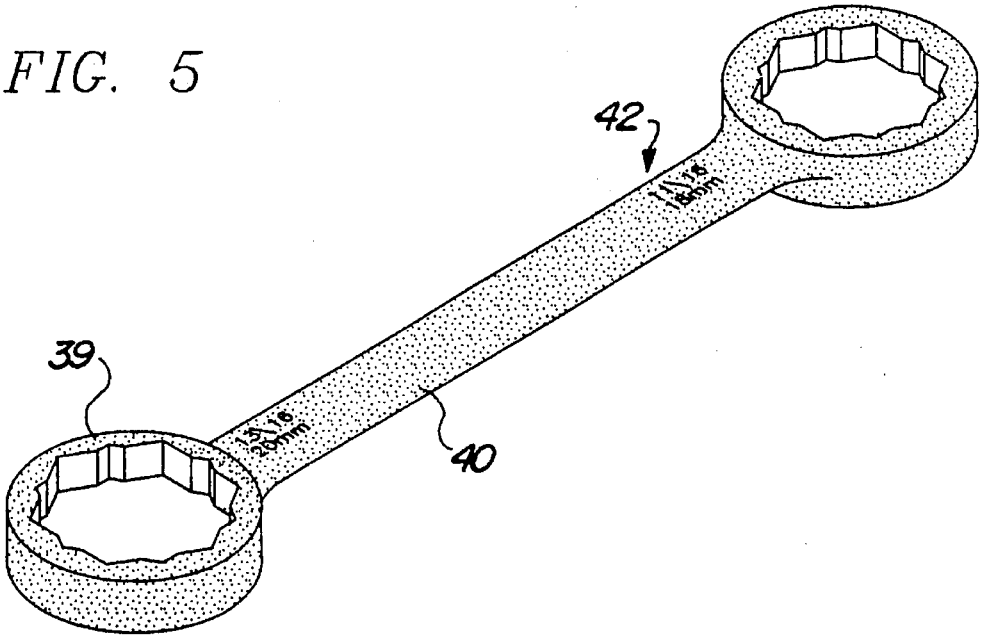
FIG. 5 is an alternate embodiment of the present invention formed as part of a wrench.
Figure 6:
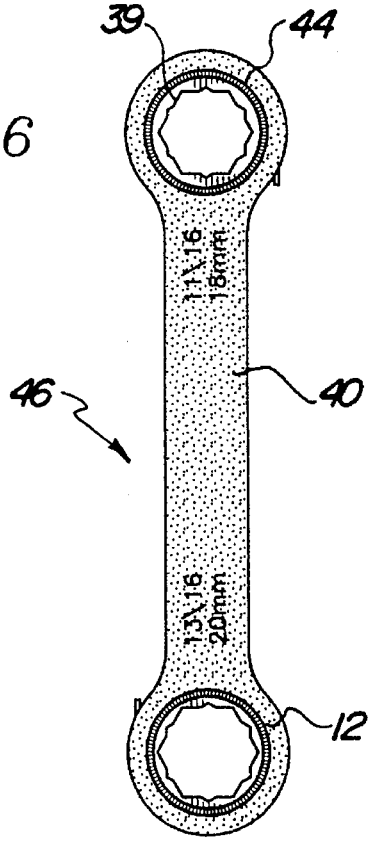
FIG. 6 is an alternate embodiment of the present invention formed as a part of a ratcheting wrench.
Figure 7:
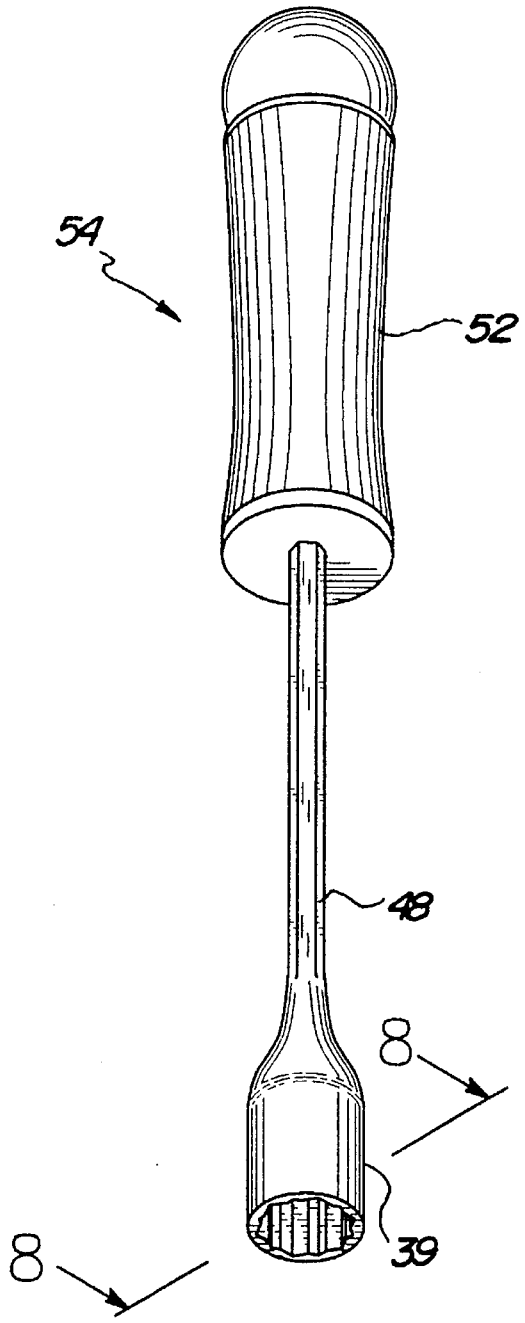
FIG. 7 is yet another alternate embodiment of the present invention formed as part of a screwdriver.
Figure 8:
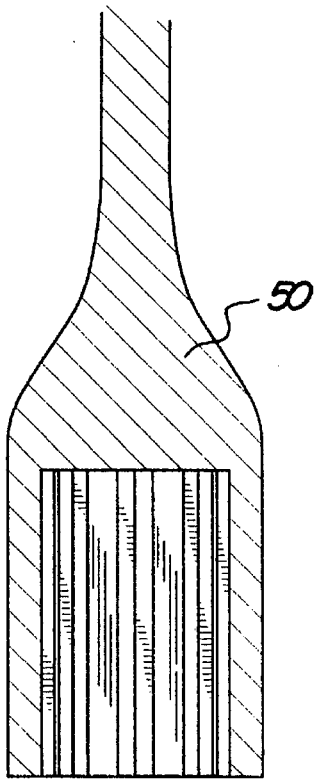
FIG. 8 is a cross-sectional view of an alternate embodiment of FIG. 7 taken along the line 8—8. The same reference numerals refer to the same parts through the various Figures.

A second embodiment of the present invention is shown in FIGS. 5 through 8. In these alternate embodiments, the body includes only bore 22 formed therein to define a drive 39. As shown in FIG. 5, a handle 40 is coupled to the drive 39 and extended therefrom to create a wrench 42. Another drive 39 can be coupled to the other end of the handle. For example the wrench of FIG. 5 accommodates English nut-type fastener sizes of 13/16 inch and 11/16 inch and Metric nut-type fastener sizes of 20 mm and 18 mm. In FIG. 6, a handle 40 is included and removably coupled to the drive 39 with a ratchet mechanism 44 to thereby create a ratcheting wrench 46. In another alternate embodiment as shown in FIG. 7, the drive 39 is coupled to a shaft 40 through a tapered end 50. The shaft 48 is extended in axial alignment from the drive and terminated at a handle 42 to thereby define a nut driver 54. These alternate embodiments utilize the combined hexagonal arrangements as previously described for allowing the sustained-application of nut-turning loads without slippage on both similarly-sized English and Metric nut-type fasteners.

The present invention combines both standard English and Metric sizes in 12-point sockets so that one tool will fit both an English hexagonal head nut or bolt and the Metric hexagonal head nut or bolt that is closest in size to it. The present invention can include 12-point sockets, box wrenches, ratcheting box wrenches, and nut drivers. These embodiments are made of alloy steel and heat treated for additional strength. Each socket has 6 points that are spaced 60 degrees apart and sized for a standard English size and another 6 points also 60 degrees apart that are located midway between the English points that are sized for the nearest Metric size. For example, one socket would fit 7/8 inch and 22 millimeter nuts or bolts. Typical combinations might be: 11/16 inch and 18 millimeters, 13/16 inch and 20 millimeters, 7/8 inch and 22 millimeters, 15/16 inch and 24 millimeters, etc. Differences between selected comparable English and Metric sizes are summarized in Table 1. Other comparable sizes can also be fashioned in an embodiment of the present invention.

TABLE 1

Differences (deltas) in Some Selected Comparable English/Metric Sizes

| Comparable English/Metric Sizes | Size in Inches | Delta between Sizes | absolute percent delta |
|---|---|---|---|
| 11/16 in | 6.88 E − 01 | −2.99 E − 02 | 2.99 E + 00 |
| 18 mm | 7.09 E − 01 | | |
| 13/16 in | 8.13 E − 01 | 3.19 E − 02 | 3.19 E + 00 |
| 20 mm | 7.87 E − 01 | | |
| 7/8 in | 8.75 E − 01 | 1.02 E − 02 | 1.02 E + 00 |
| 22 mm | 8.66 E − 01 | | |
| 15/16 in | 9.38 E − 01 | −7.81 E − 03 | 7.81 E − 01 |
| 24 mm | 9.45 E − 01 | | |

The sockets of the preferred embodiment of the present invention are used in a conventional manner. The appropriate size would be chosen for the appropriate hexagonal fastening and placed over it then the tool would be turned to tighten or loosen the fastening. The combination sockets of the present invention reduce the number of tools required. The present invention fits both English and Metric sized fastenings for maximum practicality and versatility. Instead of having to own one set of each type, a person can simply have one set incorporating both English and Metric sizes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An English-Metric wrench socket for accommodating similarly sized English and Metric nut-type fasteners for effecting sustained nut-turning loads on such fasteners without slippage comprising, in combination:

a generally cylindrical rigid body including a first free end having a bore with a square cross section extended axially therethrough, a second free end with a polygonal shaped bore extended axially therethrough and with the polygonal shaped bore bounded by a first hexagonal arrangement of twelve planar primary facets axially aligned with and offset by about thirty degrees from a second hexagonal arrangement of twelve planar secondary facets to thereby create a set of six primary points and a set of six secondary points with each primary point formed of a pair of primary facets joined at an apex to create an angle of about sixty degrees therebetween and with each secondary point formed of a pair of secondary facets joined at an apex to create an angle of about sixty degrees therebetween and wherein a first distance as measured between one of the primary facets of one of the primary points of the first arrangement and the parallel primary facet positioned directly opposite thereto is between about ½ to 3½% different than a second distance as measured between one of the secondary facets of one of the secondary points of the second arrangement and the parallel secondary facet positioned directly opposite thereto.

2. An English-Metric drive for accommodating similarly sized English and Metric nut-type fasteners comprising:

a generally cylindrical rigid body including a polygonal shaped bore extended axially therethrough and with the polygonal shaped bore bounded by a first hexagonal arrangement of twelve planar primary facets axially aligned with and offset from a second hexagonal arrangement of twelve planar secondary facets to thereby create a set of six primary points and a set of six secondary points with each primary point formed of a pair of primary facets joined at an apex and with each secondary point formed of a pair of secondary facets joined at an apex and wherein a first distance as measured between one of the primary facets of one of the primary points of the first arrangement and the parallel primary facet positioned directly opposite thereto is between about ½ to 3½% different than a second distance as measured between one of the secondary facets of one of the secondary points of the second arrangement and the parallel secondary facet positioned directly opposite thereto.

3. The English-Metric drive as set forth in claim 2 and further including a handle extended therefrom to thereby create a wrench.

4. The English-Metric drive as set forth in claim 2 and further including a handle and a ratcheting mechanism coupled between the drive and handle to thereby create a ratcheting wrench.

5. The English-Metric drive as set forth in claim 2 and further including a shaft coupled to an extended in axial alignment therefrom and with the shaft terminated at a handle to thereby create a nut driver.

6. The English-Metric wrench socket as set forth in claim 1 and further including a handle removably coupled to the first free end thereof to thereby create a socket wrench.

7. The English-Metric drive as set forth in claim 2 wherein the first distance is about 11/16 inch and the second distance is about 18 millimeters.

8. The English-Metric drive as set forth in claim 2 wherein the first distance is about 13/16 inch and the second distance is about 20 millimeters.

9. The English-Metric drive as set forth in claim 2 wherein the first distance is about 7/8 inch and the second distance is about 22 millimeters.

10. The English-Metric drive as set forth in claim 2 wherein the first distance is 15/16 inch and the second distance is 24 millimeters.

* * * * *